US009821554B2

(12) United States Patent
Fukuda

(10) Patent No.: US 9,821,554 B2
(45) **Date of Patent: *Nov. 21, 2017**

(54) LIQUID EJECTING HEAD AND LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/348,634

(22) Filed: Nov. 10, 2016

(65) Prior Publication Data

US 2017/0057231 A1 Mar. 2, 2017

Related U.S. Application Data

(63) Continuation of application No. 14/444,891, filed on Jul. 28, 2014, now Pat. No. 9,527,282.

(30) Foreign Application Priority Data

Jul. 29, 2013 (JP) ..... 2013-156499

(51) Int. Cl.
*B41J 2/14* (2006.01)

(52) U.S. Cl.
CPC ..... *B41J 2/14233* (2013.01); *B41J 2/14201* (2013.01); *B41J 2/14274* (2013.01); *B41J 2002/14241* (2013.01); *B41J 2202/11* (2013.01)

(58) Field of Classification Search
CPC ..... B41J 2/14233; B41J 2/14274; B41J 2/14142; B41J 2/14201
See application file for complete search history.

(56) References Cited

U.S. PATENT DOCUMENTS 5,748,214 A * 5/1998 Usui ..... B41J 2/14233 347/40
6,336,717 B1 1/2002 Shimada et al.
6,502,928 B1 1/2003 Shimada et al.
9,527,282 B2 * 12/2016 Fukuda ..... B41J 2/14201
(Continued)

FOREIGN PATENT DOCUMENTS

CN 1579771 2/2005
CN 1744990 3/2006
(Continued)

OTHER PUBLICATIONS

U.S. Appl. No. 14/444,891, filed Jul. 28, 2014, Fukuda.

*Primary Examiner* — Juanita D Jackson
(74) *Attorney, Agent, or Firm* — Workman Nydegger

(57) ABSTRACT

A liquid ejecting head in which a flow path substrate having a communication hole communicating with a nozzle and a pressure chamber substrate having a space that is a pressure chamber are at least laminated includes: an actuator having an active section that is interposed between electrodes and applies pressure to the pressure chamber. The pressure chamber substrate has a first space positioned in a region corresponding to the active section and a second space positioned nearer to the nozzle than the first space and communicating with the first space among the spaces. The communication hole does not overlap with the first space and overlaps with at least a part of the second space in a lamination direction.

8 Claims, 10 Drawing Sheets

(56) References Cited

U.S. PATENT DOCUMENTS

| | | | |
|---|---|---|---|
| 2005/0036008 | A1 | 2/2005 | Hirota et al. |
| 2006/0098058 | A1 | 5/2006 | Yazaki |
| 2008/0239021 | A1 | 10/2008 | Watanabe |
| 2009/0193635 | A1 | 8/2009 | Sugahara |
| 2015/0028125 | A1 | 1/2015 | Fukuda |

FOREIGN PATENT DOCUMENTS

| | | | |
|---|---|---|---|
| EP | 2594401 | | 5/2013 |
| JP | 11-115184 | A | 4/1999 |
| JP | 2000-263785 | A | 9/2000 |
| JP | 2008-238776 | | 10/2008 |
| JP | 2011-213123 | | 10/2011 |

* cited by examiner

LIQUID EJECTING HEAD AND LIQUID EJECTING APPARATUS

BACKGROUND

1. Technical Field

The present invention relates to a liquid ejecting head and a liquid ejecting apparatus.

2. Related Art

A known liquid ejecting head (for example, JP-A-2011-213123) includes an ink jet head that includes a flow path unit in which pressure chambers separated by partition walls are respectively arranged in a longitudinal direction) as well as a piezoelectric actuator for applying pressure to ink inside each pressure chamber. In the flow path unit, a pressure chamber plate, a base plate, a manifold plate, and a nozzle plate are laminated to each other. A through hole communicating with the nozzle is formed directly below the pressure chamber in the base plate and the manifold plate. Furthermore, a through hole communicating with the manifold is formed directly below the pressure chamber in the base plate.

In recent years, a high quality of output (such as a printed matter) is required resulting in increasing nozzle density. However, it is considered that as the density of the nozzles increases, the partition wall separating the pressure chambers from each other becomes thinner and the thus the rigidity of a structure forming the pressure chamber decreases. If the rigidity thereof is decreased, a phenomenon referred to as crosstalk is likely to occur that affects liquid ejected from the adjacent nozzle. Accordingly, a landing position of an ink droplet is less likely to be controlled and thereby printing quality may be decreased. Moreover, such a problem is not limited to the ink jet head and also similarly exists in various liquid ejecting heads and liquid ejecting apparatuses.

SUMMARY

An advantage of some aspects of the invention is to provide a technique capable of improving a structural strength of a pressure chamber.

According to an aspect of the invention, there is provided a liquid ejecting head in which a flow path substrate having a communication hole communicating with a nozzle and a pressure chamber substrate having a space that is a pressure chamber are at least laminated, the liquid ejecting head including: an actuator having an active section that is interposed between electrodes and applies pressure to the pressure chamber, in which the pressure chamber substrate has a first space positioned in a region corresponding to the active section and a second space positioned nearer to the nozzle than the first space and communicating with the first space among the spaces, and in which the communication hole does not overlap with the first space and overlaps with at least a part of the second space in a lamination direction.

According to another aspect of the invention, there is provided a liquid ejecting apparatus such as an ink jet printer including: the liquid ejecting head.

Since the communication hole of the flow path substrate does not overlap with the first space that is positioned in the region corresponding to the active section of the actuator in the lamination direction, it is possible to increase a rigidity of the portion overlapping with the first space in the flow path substrate and to increase the rigidity of the partition wall of the pressure chamber and the like that easily receives a force from the active section of the actuator. Therefore, the aspect described above can provide the liquid ejecting head capable of improving a structural strength of the pressure chamber, and the liquid ejecting apparatus.

Here, the flow path substrate and the pressure chamber substrate may be laminated in a state of contact with each other and may be laminated through another member.

The flow path substrate may have a second communication hole communicating with a common liquid chamber in which a liquid to be supplied to the pressure chamber is stored. The pressure chamber substrate may have a third space positioned farther from the nozzle than the first space and communicating with the first space. The second communication hole may not overlap with the first space and may overlap with at least a part of the third space in the lamination direction.

Since the second communication hole of the flow path substrate does not overlap with the first space that is positioned in the region corresponding to the active section of the actuator in the lamination direction, it is possible to increase the rigidity of the portion overlapping with the first space in the flow path substrate and to increase the rigidity of the partition wall of the pressure chamber and the like that easily receives the force from the active section of the actuator. Therefore, the aspect described above can provide the liquid ejecting head capable of further improving the structural strength of the pressure chamber.

The third space may not be positioned on the opposite side of the second space across from the first space and may be positioned on the opposite side of the second space across from the first space. The aspect can provide the liquid ejecting head capable of further improving the structural strength of the pressure chamber.

At least a part of a flow path surface facing the second communication hole in the third space may be inclined so as to approach the second communication hole as separating from the first space. The aspect can provide the preferable liquid ejecting head capable of improving the structural strength of the pressure chamber.

At least a part of a flow path surface facing the communication hole in the second space may be inclined so as to approach the communication hole as separating from the first space. The aspect can provide the preferable liquid ejecting head capable of improving the structural strength of the pressure chamber.

The pressure chamber may be formed in a substantially rectangular shape in a plan view and may be formed in a substantially elliptical shape in a plan view. The aspect can suppress largeness of the pressure chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described. Of course, the following embodiment is only intended to illustrate the invention and all of the features illustrated in the embodiment are not essential to the solving means of the invention.

1. Configuration Example of Liquid Ejecting Head

Figure 1:
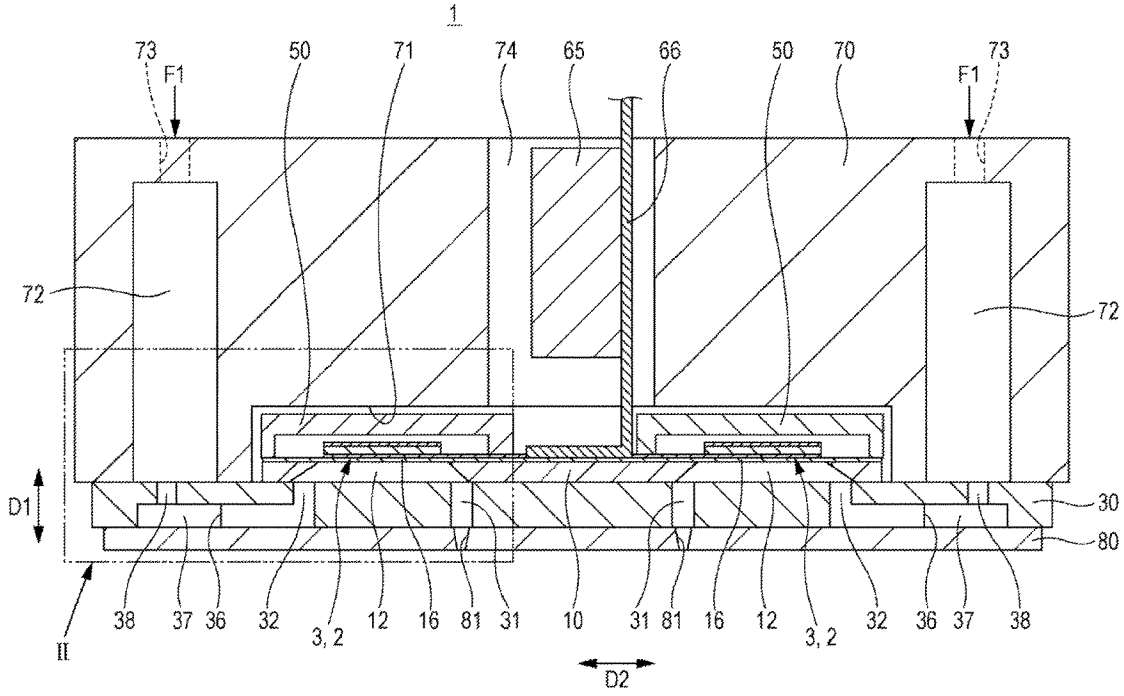
FIG. 1 is a cross-sectional view illustrating a recording head.
Figure 2:
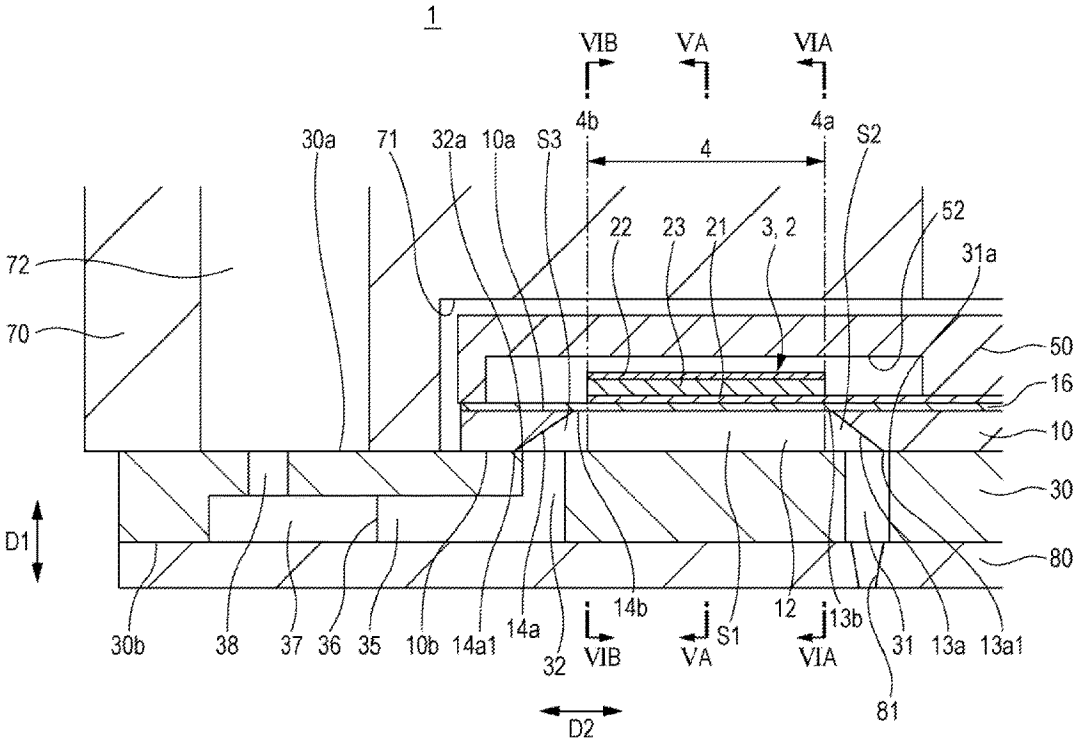
FIG. 2 is a cross-sectional view illustrating a main portion of the recording head.
Figure 3:
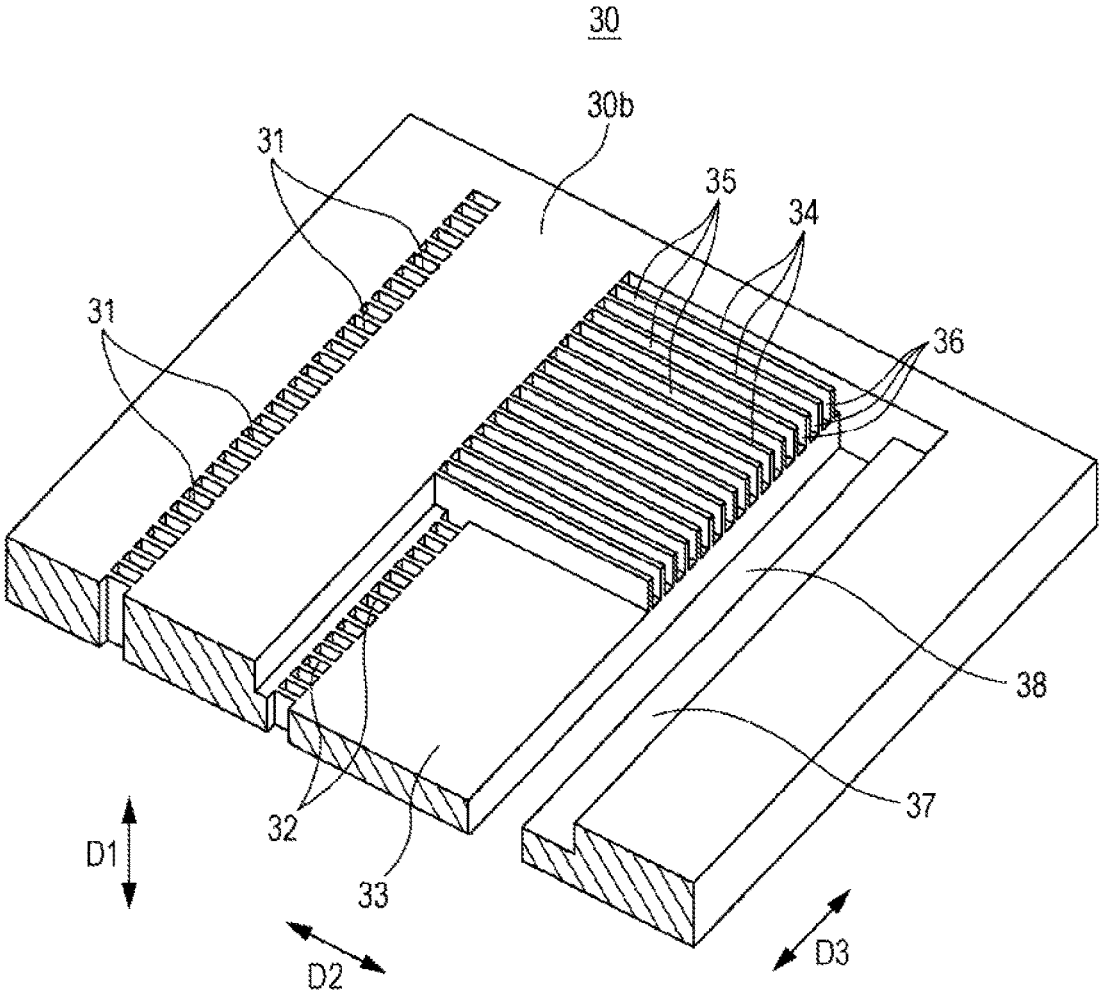
FIG. 3 is a perspective view illustrating a main portion of a flow path substrate.
Figure 4:
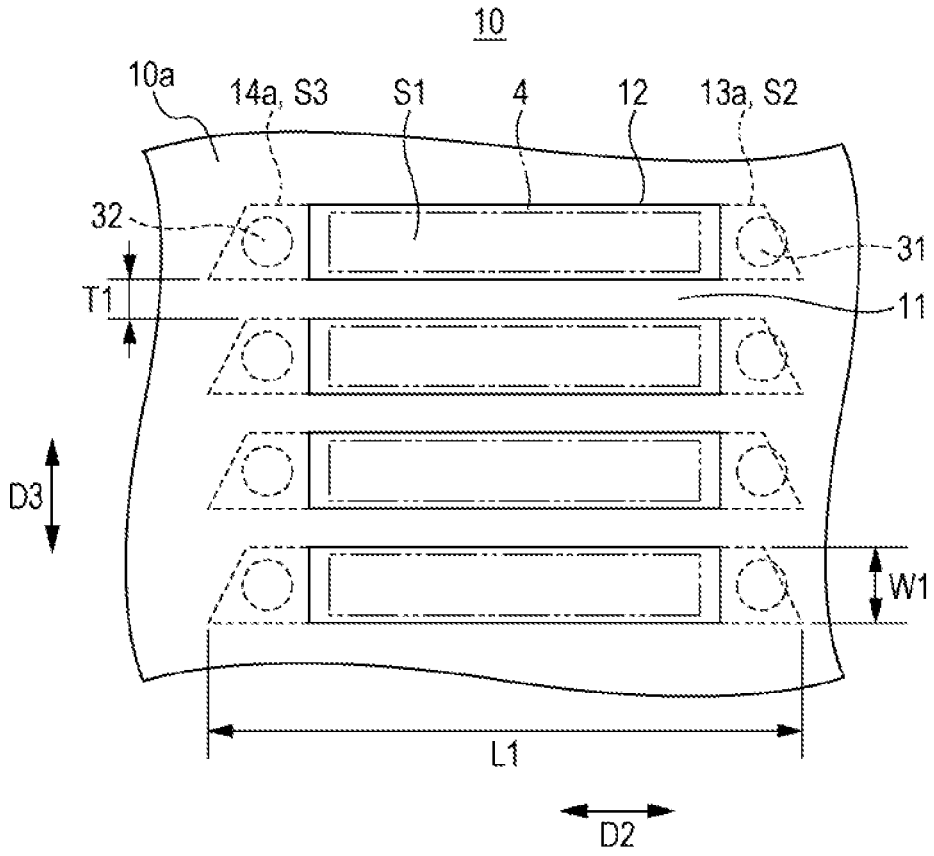
FIG. 4 is a plan view illustrating a main portion of a pressure chamber substrate.
Figure 5A:
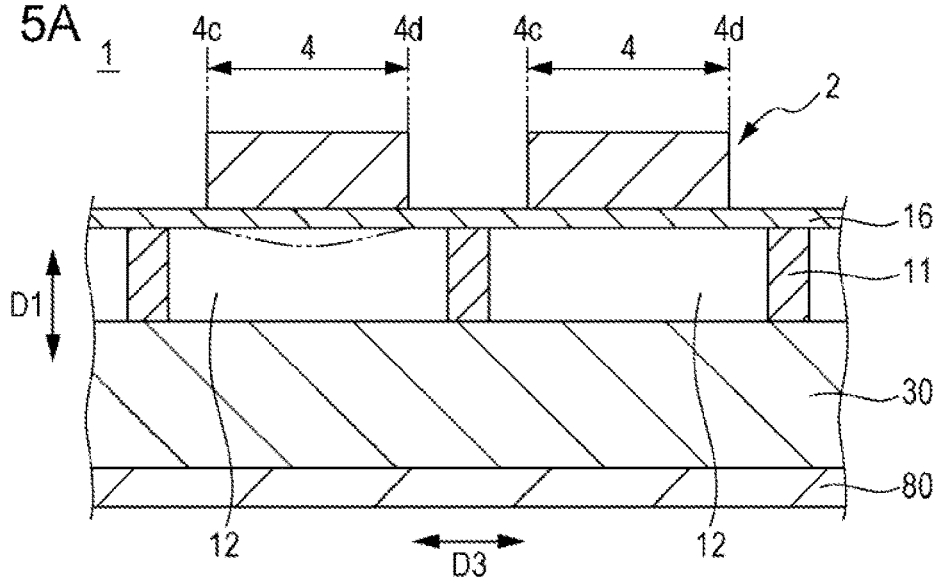
FIG. 5A is a cross-sectional view illustrating a main portion of the recording head in a position taken along line VA in FIG. 2 and FIGS. 5B and 5C are cross-sectional views illustrating a configuration of an actuator.
Figure 5B:
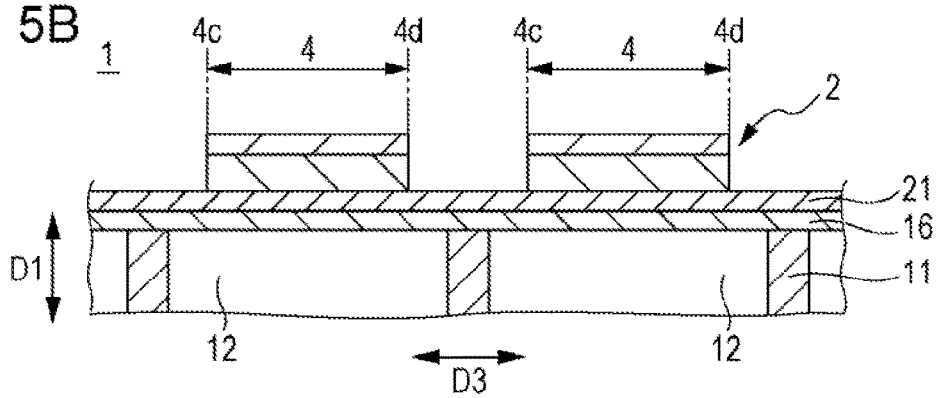
Figure 5C:
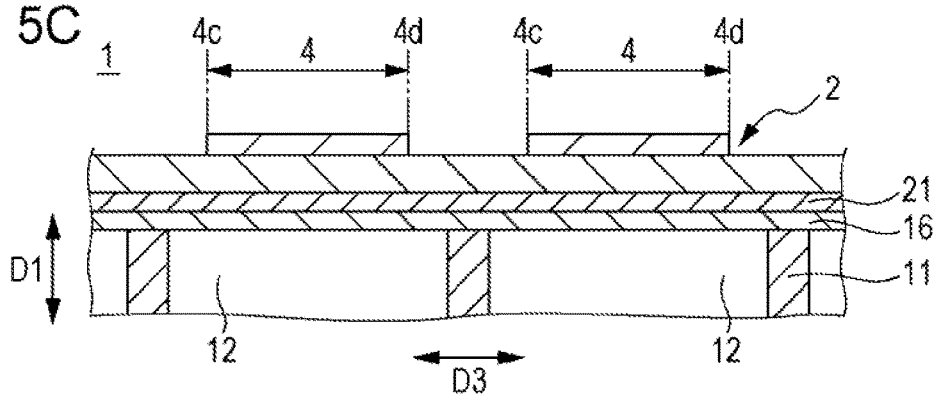
Figure 6A:
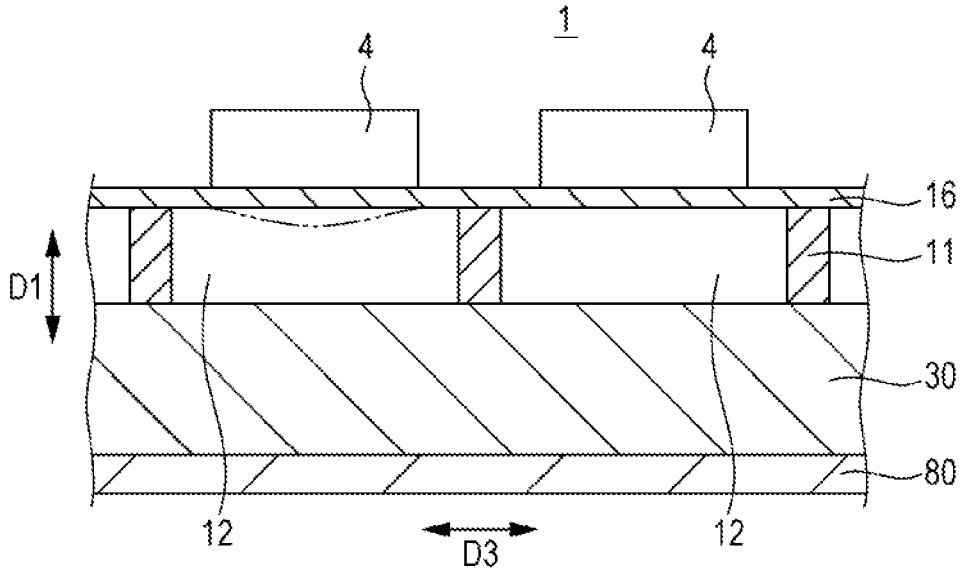
FIG. 6A is a cross-sectional view illustrating a main portion of the recording head in a position taken along line VIA in FIG. 2
Figure 6B:
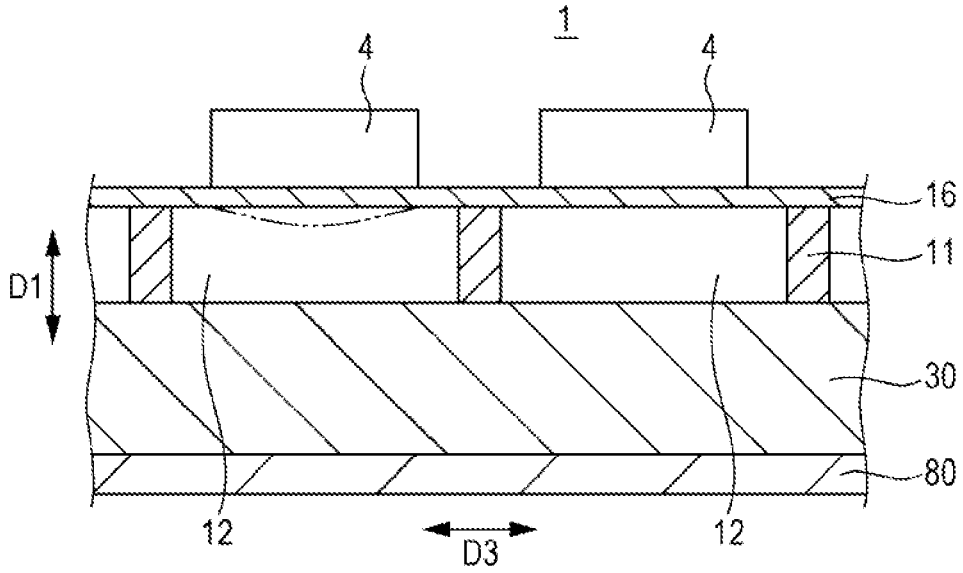
FIG. 6B is a cross-sectional view illustrating a main portion of the recording head in a position taken along line VIB in FIG. 2.

FIG. 1 is a cross-sectional view illustrating an ink jet type recording head 1 that is an example of a liquid ejecting head in a vertical plane with respect to a width direction D3 (see FIG. 4) of a pressure chamber 12. FIG. 2 is an enlarged view of a portion II in FIG. 1. FIG. 3 is a perspective view illustrating a main portion of a nozzle plate side surface 30*b* of a flow path substrate 30. FIG. 4 is a plan view illustrating a main portion of a pressure chamber substrate 10 in which, for convenience, a vibration plate 16 is shown peeled off from a vibration plate side surface 10*a* of the pressure chamber substrate 10. FIGS. 5A to 5C are cross-sectional views illustrating a main portion of the recording head 1 in a position taken along line VA in FIG. 2 in a vertical plane with respect to a longitudinal direction D2 of the pressure chamber 12. FIGS. 6A and 6B are cross-sectional views illustrating a main portion of the recording head 1 in a position taken along lines VIA and VIB respectively in FIG. 2 in the vertical plane with respect to the longitudinal direction D2 of the pressure chamber 12. In FIG. 3, an individual flow path wall 34 on a center side in the width direction D3 is not illustrated. In FIG. 4, a position of an active section 4 of an actuator 2 is illustrated by an intermittent dashed line.

In the views described above, symbol D1 illustrates a thickness direction of a piezoelectric element 3, substrates 10, 30, and 50, a case head 70, and a nozzle plate 80. Symbol D2 illustrates a longitudinal direction of the pressure chamber 12 and, for example, is a direction of an individual flow path 35 of the flow path substrate 30. Symbol D3 illustrates the width direction of the pressure chamber 12 and, for example, is an arrangement direction of the pressure chambers 12. Directions D1, D2, and D3 are orthogonal to each other, but may not be orthogonal to each other as long as they are intersecting each other. In order to be easily understood, magnification of directions D1, D2, and D3 may be different from each other and the views may not be matched to each other.

Moreover, a positional relationship described in the specification is intended to be merely exemplary for describing the invention and is not intended to limit the invention. Therefore, for example, even if the flow path substrate is disposed in a position of an upper side, a left side, a right side, or the like of the pressure chamber in addition to on a lower side of the pressure chamber, the configuration is included in the invention. Furthermore, terms of the same, orthogonal, and the like do not only mean the exact same, exactly orthogonal, and the like but also mean to include an error and the like occurring during manufacture thereof and the like. Also, contacting and bonding include both situations where adhesive is interposed therebetween and where the adhesive is absent therebetween.

The liquid ejecting head of the present technique illustrated in the recording head 1 is configured by at least laminating the flow path substrate 30 having a communication hole 31 communicating with a nozzle 81 and the pressure chamber substrate 10 having a space that is the pressure chamber 12, and includes the actuator 2 having the active section 4 that is interposed between electrodes 21 and 22 and applies pressure to the pressure chamber 12. The pressure chamber substrate 10 has a first space S1 positioned in a region corresponding to the active section 4 and a second space S2 positioned nearer to the nozzle 81 than the first space S1 and connected to the first space S1 among the spaces described above. The communication hole 31 does not overlap with the first space S1 and overlaps with at least a part of the second space S2 in the lamination direction D1. The liquid ejecting head ensures a structural strength of a pressure chamber partition wall 11 and the like by offsetting the communication hole 31 and the active section 4 so as not to overlap with each other.

Figure 7:
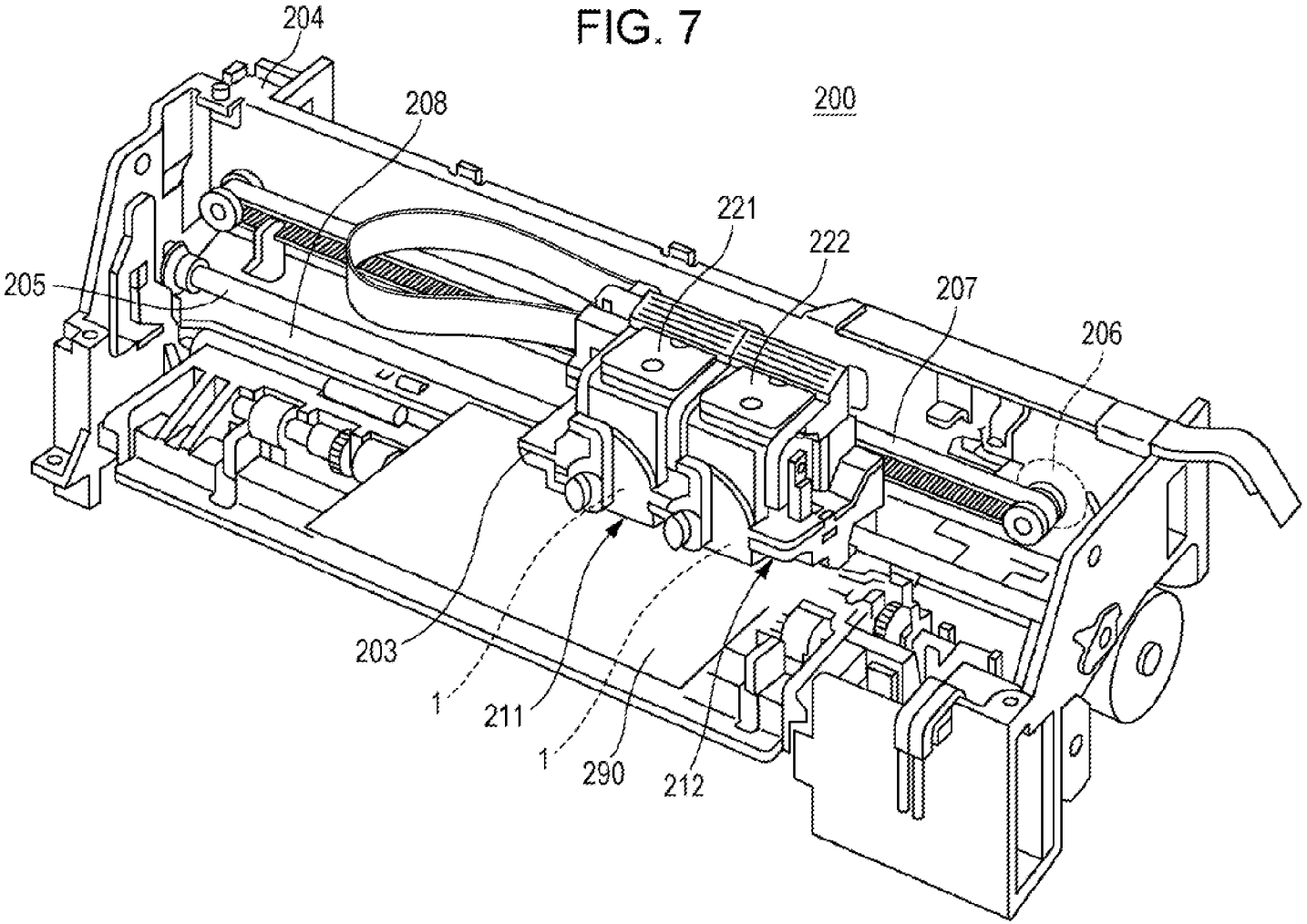
FIG. 7 is a perspective view illustrating a schematic configuration of a recording apparatus.

The liquid ejecting apparatus illustrated in a recording apparatus 200 shown in FIG. 7 includes the liquid ejecting head described above.

Here, the configuration in which the flow path substrate 30 and the pressure chamber substrate 10 are laminated includes configurations in which the two substrates 30 and 10 are bonded to each other in a state of contact with each other and in which the two substrates 30 and 10 are disposed across a different intermediating member. The configuration in which the two substrates 30 and 10 are at least laminated includes configurations in which only two substrates 30 and 10 are laminated and in which one or more different members such as the nozzle plate 80 and the two substrates 30 and 10 are laminated.

The configuration in which the communication hole 31 and the second space S2 are overlapped in the lamination direction includes all configurations in which the communication hole 31 and the second space S2 directly come into contact with each other and in which the communication hole 31 and the second space S2 are disposed through an indirect member.

The actuator 2 includes a piezoelectric element, a heating element for generating air bubbles in a pressure chamber by heating, and the like.

The recording head 1 illustrated in FIGS. 1 and 2 includes the pressure chamber substrate 10 provided with the piezoelectric actuator 2, the flow path substrate 30, a protective substrate 50, the case head 70, the nozzle plate 80, and the like.

In the pressure chamber substrate 10 illustrated in FIG. 2 and the like, the individual pressure chamber 12 corresponding to each nozzle 81 is formed, the vibration plate 16 is provided on the vibration plate side surface 10*a*, and the flow path substrate 30 is bonded to a flow path substrate side surface 10*b*. The pressure chamber substrate 10 illustrated in FIG. 2 (and the like) has the spaces S1, S2, and S3 that become the pressure chamber 12. The pressure chamber substrate 10 and the flow path substrate 30 are, for example, bonded by the adhesive. The vibration plate 16 defines a wall of the pressure chamber 12 on the side of the piezoelectric element 3 and a pressure chamber substrate side surface 30*a* of the flow path substrate 30 defines a wall of the pressure chamber 12 on the side of the flow path substrate 30. The pressure chambers 12 illustrated in FIG. 4 and the like are formed in a substantially elongated rectangular shape with respect to the pressure chamber substrate 10 in a plan view and are arranged in the width direction D3 through the partition wall 11. In recent years, a high density of the nozzles is required, and thus the partition wall 11 partitioning between the pressure chambers 12 becomes thin. If the partition wall 11 is thin, the structural strength of the pressure chamber 12 may be decreased.

As a material of the pressure chamber substrate 10, it is possible to use a silicon substrate, metal such as stainless steel (SUS), ceramics, glass, synthetic resin, and the like. As an example, the pressure chamber substrate 10 is not specifically limited, but it is possible to be formed of a single crystal silicon substrate having high rigidity and a relatively thick film thickness of, for example, several hundreds μm. The pressure chambers 12 divided by a plurality of partition walls 11 may be formed, for example, by anisotropic etching (wet etching) and the like using an alkaline solution such as a KOH aqueous solution.

The actuator 2 illustrated in FIG. 2 and the like includes the vibration plate 16 and the piezoelectric element 3.

As a material of the vibration plate 16, it is possible to use silicon oxide (SiOx), metal oxides, ceramics, synthetic resin, and the like. The vibration plate may be integrally formed with the pressure chamber substrate by modifying the surface of the pressure chamber substrate that is not separated and may be laminated by bonding to the pressure chamber substrate. Furthermore, the vibration plate may be configured of a plurality of films. As an example, an elastic film such as a silicon oxide film is formed on the pressure chamber substrate made of silicon, an insulating film such as zirconium oxide (ZrOx) is formed on the elastic film, and the vibration plate (having, for example, a thickness of approximately several hundreds nm to several μm, but which is not specifically limited) may be configured of a laminated film including the elastic film and the insulating film. For example, the elastic film may be formed on the pressure chamber substrate by performing thermal oxidation of a silicon wafer for the pressure chamber substrate in a diffusion furnace at approximately 1000° C. to 1200° C. For example, the insulating film may be formed by performing thermal oxidation of a zirconium (Zr) layer and the like in the diffusion furnace at approximately 500° C. to 1200° C. after forming the zirconium (Zr) layer on the elastic film using a vapor phase method and the like such as a sputtering method.

The piezoelectric element 3 illustrated in FIG. 2 has a piezoelectric body layer 23, a lower electrode (first electrode) 21 provided on the side of the pressure chamber 12 of the piezoelectric body layer 23, an upper electrode (second electrode) 22 provided on the other side of the piezoelectric body layer 23, and is provided on the vibration plate 16. One of the electrodes 21 and 22 may be a common electrode. A configuration in which the lower electrode 21, for example, as the individual electrode, is connected to a connection wiring 66 such as a flexible substrate is illustrated in FIG. 2, and the upper electrode 22 is, for example, grounded as the common electrode. As both electrodes, it is possible to use a material of one or more types of platinum (Pt), gold (Au), iridium (Ir), titanium (Ti), conductive oxides of these metals, and the like, and the thickness thereof may be, for example, several nm to several hundred nm, but is not specifically limited. At least one of the lower electrode and the upper electrode may be connected to a lead electrode formed of a conductive material such as metal. As the piezoelectric body layer 23, it is possible to use a ferroelectric material and the like such as lead-based perovskite-type oxides such as lead zirconate titanate ((PZT), Pb (Zrx, Ti1-x) $O_3$ in a stoichiometric ratio), non-lead-based perovskite-type oxides. The thickness thereof may be, for example, approximately several hundred nm to several μm, but is not specifically limited.

The lower electrode 21, the upper electrode 22, or the lead electrode may be formed by, for example, sputtering and the like by forming an electrode film on the vibration plate using a vapor phase method and the like such as the sputtering method. The piezoelectric body layer 23 may be formed by sputtering by forming a piezoelectric body precursor film on the lower electrode using a liquid phase method (such as a spin coating method) or a vapor phase method, and by crystallizing the piezoelectric body precursor film using sintering or the like.

The active section 4 that is a moving portion in the piezoelectric element 3 is a region in which the piezoelectric body layer 23 is interposed between both electrodes 21 and 22. The portion of the piezoelectric element 3 existing between active ends 4*a* and 4*b* in the longitudinal direction (that constitutes an inner side spanning both end sections of the pressure chamber 12 in the longitudinal direction D2) is the active section 4. In the example of FIG. 2, the area outside of the active section 4 is an inactive section. The active end 4*a* on the right side (on the side of the nozzle 81) of the active section 4 in the longitudinal direction D2 is an end section of the upper electrode 22 and the piezoelectric body layer 23. The lower electrode 21 further extends from the active end 4*a* to the right side. The active end 4*b* on the left side (on the side of a common liquid chamber 37) of the active section 4 in the longitudinal direction D2 is an end section of both the electrodes 21 and 22, and the piezoelectric body layer 23.

FIG. 5A illustrates an example in which the active section 4 is provided on the vibration plate 16 between active ends 4*c* and 4*d* in the width direction. The vibration plate 16 further becomes an inner side of both end sections of the pressure chamber 12 in the width direction D3.

The piezoelectric element 3 of a portion existing between the active ends 4*c* and 4*d* that becomes an inner side for both end sections of the pressure chamber 12 in the width direction D3 is the active section 4, and the outside of the active section 4 is an inactive section in the example of FIGS. 5B and 5C. An example in which the active ends 4*c* and 4*d* in the width direction are end sections of the upper electrode 22 and the piezoelectric body layer 23, and the lower electrode 21 further extends from the active ends 4*c* and 4*d* to the outside is illustrated in FIG. 5B. Even though not illustrated, in a case of the piezoelectric element having a common upper electrode structure in which the upper electrode is connected in the width direction D3, the end section of the lower electrode becomes the active end in the width direction within a range in which the piezoelectric body layer exists in the width direction D3.

FIG. 5C illustrates an example in which the active ends 4*c* and 4*d* in the width direction are end sections of the upper electrode 22, but the lower electrode 21 and the piezoelectric body layer 23 further extend from the active ends 4*c* and 4*d* to the outside. In a case of the common upper electrode structure, the end section of the lower electrode becomes the active end in the width direction.

As illustrated in FIGS. 2, 4, 5A, and the like, a space positioned in a region corresponding to the active section 4 in the pressure chamber substrate 10 is the first space S1. The first space S1 is partially overlapped with the active section 4 in a plan view among the spaces in which the pressure chamber substrate 10 is formed and is a space that is in a portion in which the active section 4 is projected with respect to the pressure chamber substrate 10 in the thickness direction D1. Pressure from the active section 4 is applied directly to the first space S1.

The second space S2 connected to the first space S1 is formed from the active end 4*a* in the longitudinal direction in the pressure chamber substrate 10 on the side of the nozzle 81 in the longitudinal direction D2. The second space S2 is positioned nearer to the nozzle 81 than the first space S1 and is adjacent to the first communication hole 31 of the flow path substrate 30, in other words, at least a part of the second space S2 in a plan view overlies the first communication hole 31. At least a part (a second space inclined surface 13*a*) of a counter flow path surface facing the communication hole 31 in the second space S2 is inclined so as to approach the communication hole 31 the flow exits from the first space S1. A second space non-inclined surface 13*b* (that is not inclined) formed on the counter flow path surface is illustrated in FIG. 2. The non-inclined surface 13*b* may not be present and all of the counter flow path surface may be configured of the inclined surface 13*a*. The inclined surface 13*a* is not only a planar surface but may also be a curved surface. An edge section 13*a*1 of the inclined surface 13*a* on the side of the flow path substrate 30 illustrated in FIG. 2 is positioned nearer to the first space S1 than an edge section 31*a* positioned on the opposite side of the first space S1 in the communication hole 31.

A third space S3 connected to the first space S1 is formed from the active end 4*b* in the longitudinal direction in the pressure chamber substrate 10 on the side of the common liquid chamber 37 in the longitudinal direction D2. The third space S3 is positioned on the opposite side of the second space S2 across from the first space S1 and is separated from the second space S2. The third space S3 is positioned nearer to the common liquid chamber 37 than the first space S1 and is adjacent to a second communication hole 32 of the flow path substrate 30. In other words, at least a part thereof in a plan view overlaps with the second communication hole 32. The configuration in which at least a part of the third space S3 overlaps with the communication hole 32 in a plan view includes all configurations in which the communication hole 32 comes into contact with the third space S3 and in which the communication hole 32 and the third space S3 are disposed through an indirect member. At least a part (a third space inclined surface 14*a*) of a counter flow path surface facing the communication hole 32 in the third space S3 is inclined so as to approach the communication hole 32 as separating from the first space S1. A third space non-inclined surface 14*b* that is not inclined formed on the counter flow path surface is illustrated in FIG. 2. The non-inclined surface 14*b* may not be present and all of the counter flow path surface may be configured of the inclined surface 14*a*. The inclined surface 14*a* is not only a planar surface but may also be a curved surface. An edge section 14*a*1 of the inclined surface 14*a* on the side of the flow path substrate 30 illustrated in FIG. 2 is positioned farther from the first space S1 than an edge section 32*a* positioned on the opposite side of the first space S1 in the communication hole 32.

Moreover, liquid F1 of the pressure chamber 12 moves from the first space S1 through the first communication hole 31 in the longitudinal direction D2 as far as the second space S2. Therefore, if the second space inclined surface 13*a* is not present and the second space S2 is a substantially rectangular parallelepiped shape, the liquid F1 is likely to stay in the second space S2, flow of the liquid F1 is interfered with, or air bubbles are likely to easily stay in the second space S2. Furthermore, the liquid F1 of the pressure chamber 12 moves from the second communication hole 32 through the first space S1 in the longitudinal direction D2 as much as the third space S3. Therefore, if the third space inclined surface 14*a* is not present and the third space S3 is a substantially rectangular parallelepiped shape, the liquid F1 is likely to stay in the third space S3, flow of the liquid F1 is interfered with or the air bubbles are likely to easily stay in the third space S3.

From the above, if the inclined surface 13*a* is provided in the second space S2 and the inclined surface 14*a* is provided in the third space S3, it is possible to suppress the problems described above.

However, if the pressure chamber substrate is formed of a metal plate such as stainless steel using a punching process, the inclined surfaces 13*a* and 14*a* are not easily formed. If the pressure chamber substrate 10 is formed of a silicon substrate, it is possible to easily form the inclined surfaces 13*a* and 14*a* by anisotropic etching.

The flow path substrate 30 illustrated in FIGS. 2, 3 (and the like) has a liquid flow path that includes the individual communication holes 31 and 32 correspond to each nozzle 81, and the common liquid chamber 37 storing the liquid F1 such as ink to be supplied to the pressure chamber 12. The pressure chamber substrate 10 and the case head 70 are bonded to the pressure chamber substrate side surface 30*a* of the flow path substrate 30. For example, the flow path substrate 30 and the case head 70 are bonded by the adhesive. The nozzle plate 80 is bonded to the nozzle plate side surface 30*b* of the flow path substrate 30. For example, the flow path substrate 30 and the nozzle plate 80 are bonded by the adhesive.

As a material of the flow path substrate 30, it is possible to use a silicon substrate, metal such as stainless steel, ceramics, glass, and synthetic resin. As an example, the flow path substrate 30 is not specifically limited, but it is possible to be formed of a single crystal silicon substrate relatively thick having a high rigidity. The liquid flow path such as the communication holes 31 and 32 or the common liquid chamber 37 may be formed, for example, by anisotropic etching (wet etching) and the like using an alkaline solution such as a KOH aqueous solution.

The first communication hole 31 is positioned between the second space S2 of the pressure chamber substrate 10 and the nozzle 81 of the nozzle plate 80, and is adjacent to the second space S2. In other words, at least a part of the first communication hole 31 overlaps with the second space S2 in a plan view, and allows the second space S2 to communicate with the nozzle 81. Meanwhile, the communication hole 31 is not adjacent to the first space S1. In other words, the communication hole does not overlap with the first space S1 in a plan view. Since the communication hole 31 is not adjacent to the first space S1, the liquid F1 of the first space S1 does not directly flow into the communication hole 31, but rather moves to the communication hole 31 after flowing into the second space S2. As illustrated in FIG. 6A, in an example of a vertical cross section with respect to the longitudinal direction D2 in the position of line VIA in FIG. 2, the flow path substrate 30 directly below the pressure chamber 12 is solid in a position corresponding to the active end 4*a* in the longitudinal direction and the communication hole 31 is positioned on the side of the nozzle 81 from the active end 4*a* in the longitudinal direction D2.

The second communication hole 32 is positioned between the third space S3 of the pressure chamber substrate 10 and the common liquid chamber 37 of the flow path substrate 30. The second communication hole 32 is adjacent to third space S3. In other words, at least a part of the second communication hole 32 overlaps the third space S3 in a plan view, and allows the third space S3 to communicate with the common liquid chamber 37. Meanwhile, the communication hole 32 is not adjacent the first space S1. In other words, the communication hole 32 does not overlap with the first space S1 in a plan view. Since the communication hole 32 is not adjacent to the first space S1, the liquid F1 of the communication hole 32 does not directly flow into the first space S1, but rather moves to the first space S1 after flowing into the third space S3. As illustrated in FIG. 6B, in an example of a vertical cross section with respect to the longitudinal direction D2 in the position of line VIB in FIG. 2, the flow path substrate 30 directly below the pressure chamber 12 is solid in a position corresponding to the active end 4*b* in the longitudinal direction and the communication hole 32 is positioned on the side of the common liquid chamber 37 from the active end 4*b* in the longitudinal direction D2.

An inflow hole 38 of the liquid F1 into the common liquid chamber 37 is a common flow path connected to a common liquid chamber 72 formed in the case head 70 and allows communication between the common liquid chambers 72 and 37. The common liquid chambers 72 and 37 are also referred to as a reservoir. The shape of the inflow hole 38 includes a slit shape illustrated in FIG. 3, a circular shape, an elliptical shape, a polygonal shape, and the like. The number of the inflow holes 38 may be one and may be two or more. A half etching section 33 (that is recessed from the nozzle plate side surface 30*b*) is formed on the side of the second communication hole 32 from the inflow hole 38 in the longitudinal direction D2 of the pressure chamber. The flow path wall 34 (forming the individual flow path 35 that allows the liquid F1 to flow into the pressure chamber in the longitudinal direction D2) extends from the half etching section 33 to the side of the nozzle plate 80. The liquid F1 which has flowed from the inflow hole 38 into the common liquid chamber 37 enters the flow path 35 from an individual supply port 36 and enters the third space S3 of the pressure chamber substrate 10 through the communication hole 32.

The protective substrate 50 illustrated in FIG. 2 (and the like) has a space forming section 52 in a region corresponding to the active section 4 and is bonded on the pressure chamber substrate 10 on which the piezoelectric element 3 is formed. The protective substrate 50 and the pressure chamber substrate 10 provided with the piezoelectric element 3 are bonded by, for example, an adhesive. The space forming section 52 has a space that does not hinder movement of the active section 4. As a material of the protective substrate 50, it is possible to use a silicon substrate, metal such as stainless steel, ceramics, glass, synthetic resin, and the like. As an example, the protective substrate 50 is not specifically limited, but it is possible to be formed of a single crystal silicon substrate having high rigidity and a relatively thick film thickness of, for example, several hundreds μm.

The case head 70 illustrated in FIG. 1 (and the like) has a space forming section 71 that is positioned in a region corresponding to the protective substrate 50, a gap 74 through which the connection wiring 66 passes, and so forth. The space forming region 71 forms the common liquid chamber 72 in which the liquid F1 to be supplied to the pressure chamber 12 is stored, and is bonded to the flow path substrate 30. The space forming section 71 has a space in which the protective substrate 50 enters. The common liquid chamber 72 stores the liquid F1 which has flowed from a liquid introduction section 73. The pressure chamber substrate side surface 30*a* of the flow path substrate 30 defines a part of a wall of the pressure chamber 12 and also defines a part of a wall of the common liquid chamber 72. As a material of the case head 70, it is possible to use glass, ceramics, metal such as stainless steel, synthetic resin, silicon substrate, and the like.

A driving circuit 65 illustrated in FIG. 1 drives the piezoelectric element 3 through the connection wiring 66. As the driving circuit 65, it is possible to use a circuit substrate, a semiconductor integrated circuit (IC), and the like. As the connection wiring 66, it is possible to use a flexible substrate and the like.

The nozzle plate 80 illustrated in FIG. 2 and the like has a plurality of nozzles 81 passing through in the thickness direction D1 and is bonded to the flow path substrate 30. As a material of the nozzle plate 80, it is possible to use metal such as stainless steel, glass, ceramics, synthetic resin, silicon substrate, and the like. As an example, the nozzle plate 80 is not specifically limited, but it is possible to be formed of glass ceramics and the like having a thickness of, for example, approximately 0.01 mm to 1 mm.

The recording head 1 takes in the liquid F1 such as the ink from the liquid introduction section 73 connected to an external liquid supply unit (not illustrated) and the inside thereof is filled with the liquid F1 from the common liquid chamber 72 to the nozzle opening (the nozzle 81) through the inflow hole 38, the common liquid chamber 37, the individual flow path 35, the second communication hole 32, the third space S3, the first space S1, the second space S2, and the first communication hole 31. If a voltage is applied between the lower electrode 21 and the upper electrode 22 for each pressure chamber 12 (depending on a recording signal from the driving circuit 65), pressure is applied to the inside of the pressure chamber 12 by deformation of the piezoelectric body layer 23 that is the active section 4, the lower electrode 21, and the vibration plate 16, and liquid droplets such as ink droplets are ejected from the nozzle opening (the nozzle 81).

2. Operation and Effect of Liquid Ejecting Head

Next, an operation and effect of the recording head 1 will be described.

Figure 9:
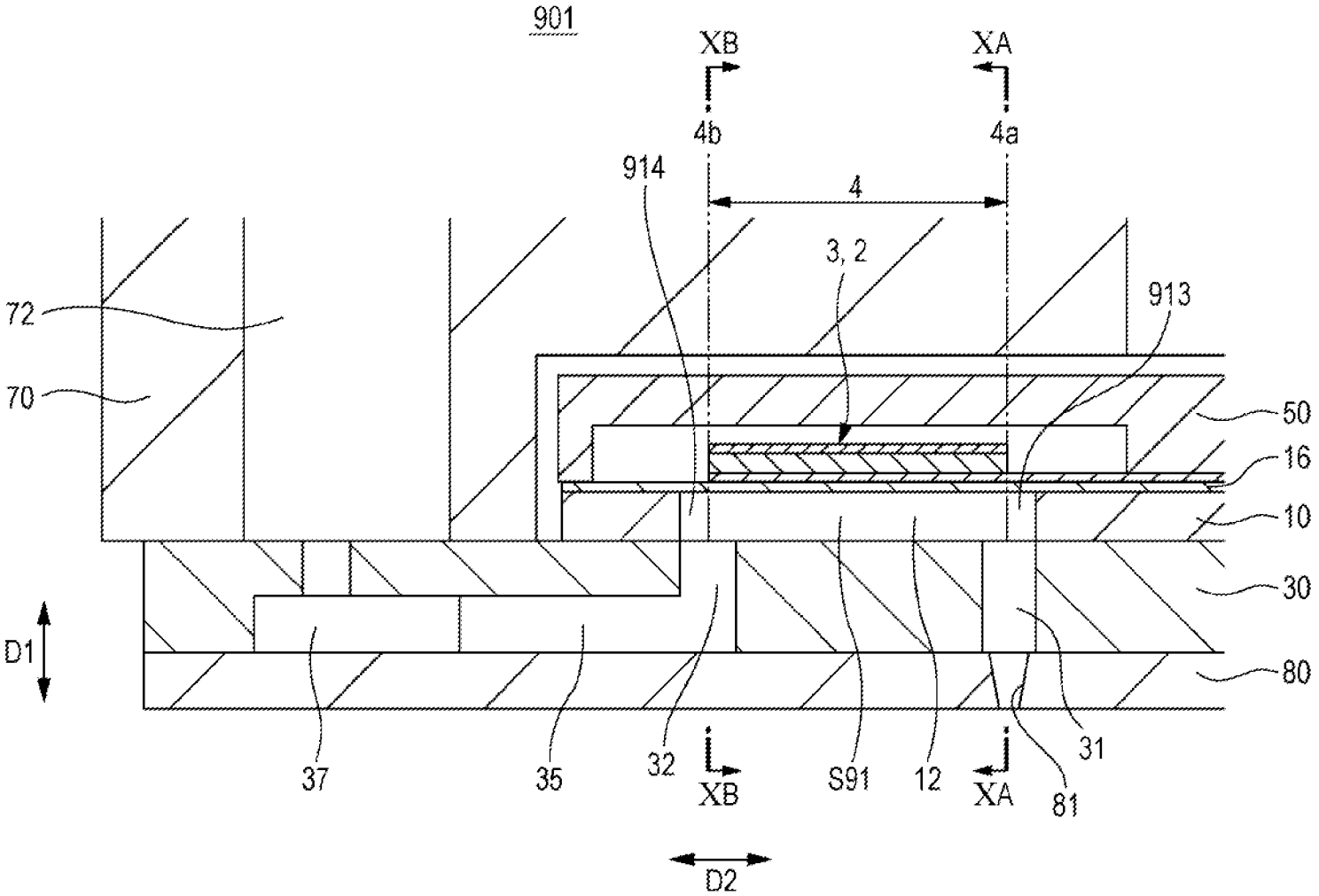
FIG. 9 is a cross-sectional view illustrating a main portion of a recording head of a comparative example.
Figure 10A:
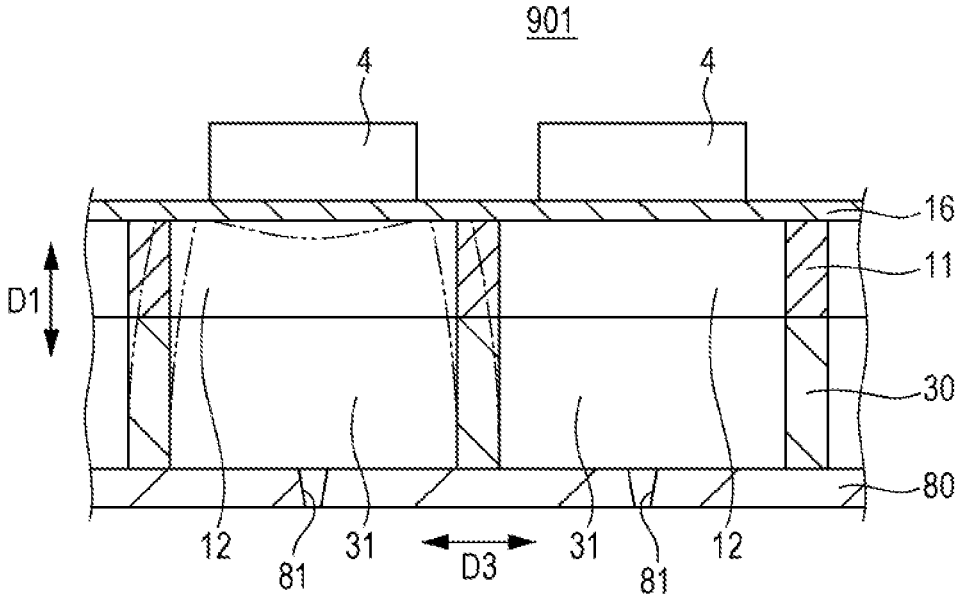
FIG. 10A is a cross-sectional view illustrating a main portion of a recording head in a position taken along line XA in FIG. 9
Figure 10B:
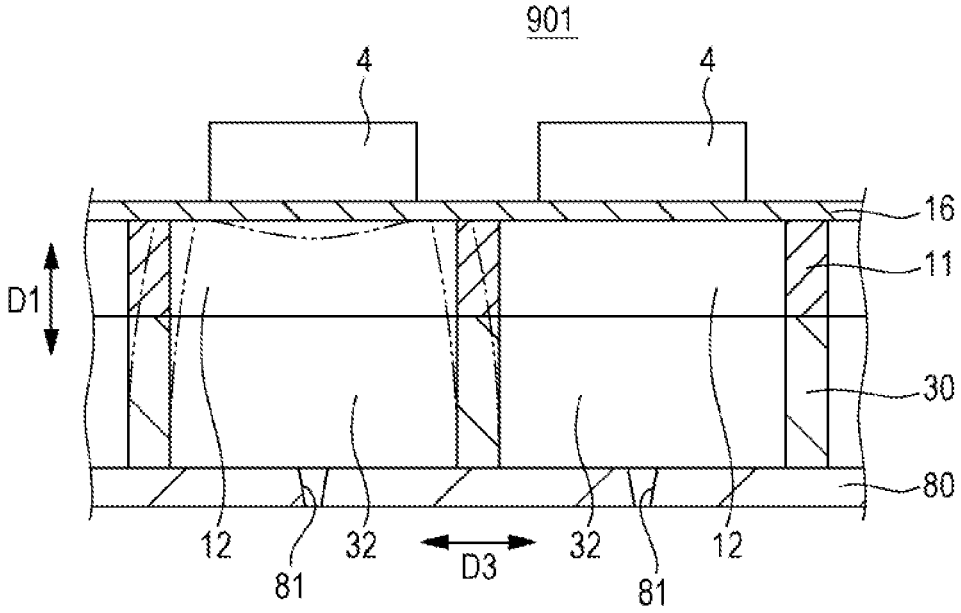
FIG. 10B is a cross-sectional view illustrating a main portion of the recording head in a position taken along line XB in FIG. 9.

FIG. 9 is a cross-sectional view illustrating a main portion of a recording head 901 of a comparative example in a width direction D3 of a pressure chamber 12 in the vertical plane. FIGS. 10A and 10B are cross-sectional views illustrating a main portion of the recording head 901 in a position taken along lines XA and XB in FIG. 9 in the longitudinal direction D2 of the pressure chamber 12 in the vertical plane. In the configuration elements illustrated in FIGS. 9, 10A, and 10B, symbols are given as corresponding to the configuration elements illustrated in FIGS. 1 to 6A and 6B.

In the recording head 901, the first communication hole 31 is directly below a longitudinal direction active end 4*a* and is adjacent to a space S91 of a region corresponding to the active section 4, in other words, at least a part thereof overlaps with the space S91 in a plan view, and the space S91 and the nozzle 81 communicate with each other. As illustrated in FIG. 10A, since a wall of the communication hole 31 of the flow path substrate 30 supports the partition wall 11 in a position corresponding to the longitudinal direction active end 4*a*, when the active section 4 applies pressure to the pressure chamber 12 by inflating to the side of the pressure chamber 12, as illustrated by a intermittent dashed line in FIG. 10A, the partition wall 11 is easily deformed. When the partition wall 11 is deformed, a pressure change occurs in the adjacent pressure chamber 12 in the width direction D3 and it is possible for a phenomenon referred to as crosstalk to occur that affects liquid ejected from the adjacent nozzle, and printing quality may be reduced because landing positions of the liquid droplets are unlikely to be controlled.

Furthermore, the second communication hole 32 of the recording head 901 is directly below a longitudinal direction active end 4*b* and is adjacent to the space S91 of a region corresponding to the active section 4. In other words, at least a part of the second communication hole 32 overlaps with the space S91 in a plan view, and the space S91 and the common liquid chamber 37 communicate with each other. As illustrated in FIG. 10B, since a wall of the communication hole 32 of the flow path substrate 30 supports the partition wall 11 in a position corresponding to the longitudinal direction active end 4*b*, when the active section 4 applies pressure to the pressure chamber 12 by inflating into the side of the pressure chamber 12, as illustrated by a intermittent dashed line in FIG. 10B, the partition wall 11 is easily deformed. Also, from this, the crosstalk phenomenon may occur and the printing quality may be decreased.

Meanwhile, the first communication hole 31 of the recording head 1 illustrated in FIG. 2 is positioned on the side of the nozzle 81 from the longitudinal direction active end 4*a* in the longitudinal direction D2. As illustrated in FIG. 6A, since the solid portion of the flow path substrate 30 may support the partition wall 11 in the position corresponding to the longitudinal direction active end 4*a*, when the active section 4 applies pressure to the pressure chamber 12 by inflating into the side of the pressure chamber 12, the partition wall 11 is unlikely to deform and the crosstalk phenomenon is unlikely to occur. As described above, according to the technique, it is possible to increase the rigidity of the portion overlapping with the first space S1 in the lamination direction in the flow path substrate 30 and to increase the rigidity of the pressure chamber partition wall 11 and the like that easily receive a force from the active section 4, and to improve a structural strength of the pressure chamber 12, thereby improving the printing quality.

Furthermore, the second communication hole 32 of the recording head 1 is positioned on the side of the common liquid chamber 37 from the longitudinal direction active end 4*b* in the longitudinal direction D2. As illustrated in FIG. 6B, since the solid portion of the flow path substrate 30 may support the partition wall 11 in the position corresponding to the longitudinal direction active end 4*b*, when the active section 4 applies pressure to the pressure chamber 12 by inflating to the side of the pressure chamber 12, the partition wall 11 is unlikely to deform and the crosstalk phenomenon is unlikely to occur. Also, from this, according to the technique, it is possible to increase the rigidity of the portion overlapping with the first space S1 in the lamination direction in the flow path substrate 30 and to improve the structural strength of the pressure chamber 12, thereby improving the printing quality.

Moreover, as the recording head 901 illustrated in FIG. 9, if an end section 913 connected to the first communication hole 31 in the pressure chamber 12 is a substantially rectangular parallelepiped shape, the liquid is likely to stay in the end section 913 and the flow of the liquid is interfered with or the air bubbles are likely to easily stay in the end section 913. Furthermore, as illustrated in FIG. 9, if an end section 914 connected to the second communication hole 32 in the pressure chamber 12 is a substantially rectangular parallelepiped shape, the liquid is likely to stay in the end section 914 and the flow of the liquid is interfered with or the air bubbles are likely to easily stay in the end section 914.

Meanwhile, since the recording head 1 illustrated in FIG. 2 has the second space inclined surface 13*a* on the flow path surface facing the first communication hole 31 in the second space S2, the liquid is unlikely to stay in the second space S2 and the liquid smoothly flows in the second space S2. Accordingly, air bubbles are unlikely to stay in the second space S2. Furthermore, as illustrated in FIG. 2, since the third space inclined surface 14*a* is in the flow path surface facing the second communication hole 32 in the third space S3, the liquid is unlikely to stay in the third space S3 and the liquid smoothly flows in the third space S3, and the air bubbles are unlikely to stay in the third space S3.

Furthermore, since the edge section 13*a*1 of the second space inclined surface 13*a* on the side of the flow path substrate 30 is positioned on the inside of the first communication hole 31, also in this respect, the liquid and the air bubbles are unlikely to stay in the second space S2. Furthermore, since the edge section 14*a*1 of the third space inclined surface 14*a* on the side of the flow path substrate 30 is positioned on the outside of the second communication hole 32, also in this respect, air bubbles are unlikely to stay in the third space S3.

3. Liquid Ejecting Apparatus

FIG. 7 illustrates an appearance of the ink jet type recording apparatus (liquid ejecting apparatus) 200 having the recording head 1 described above. When incorporating the recording head 1 into recording head units 211 and 212, it is possible to manufacture the recording apparatus 200. In the recording apparatus 200 illustrated in FIG. 7, the recording head 1 is provided and ink cartridges 221 and 222 that are external ink supply units are detachably provided in the recording head units 211 and 212, respectively. A carriage 203 on which the recording head units 211 and 212 are mounted is provided so as to reciprocate along a carriage shaft 205 attached to an apparatus body 204. When a driving force of a driving motor 206 is transmitted to the carriage 203 through a plurality of gears (not illustrated) and a timing belt 207, carriage 203 moves along the carriage shaft 205. A recording sheet 290 being fed by a feeding roller and the like (not illustrated) is transported to on a platen 208 and printing is performed by the ink (liquid) that is supplied from the ink cartridges 221 and 222, and is ejected from the recording head 1.

4. Modification Example

In the invention, various modifications can be considered.

For example, the liquid ejected from the liquid ejecting head includes a fluid and the like such as a solution in which dyes and the like are dissolved in a solvent and a sol in which solid particles such as pigments or metal particles are dispersed in a dispersion medium. Such a fluid includes ink, liquid crystal, and the like. The liquid ejecting head may be mounted on an apparatus for manufacturing a color filter for a liquid crystal display and the like, an apparatus for manufacturing the electrodes of an organic EL display and the like, an apparatus for manufacturing biochips, and the like in addition to an image recording apparatus such as the printer.

The common liquid chamber that supplies the liquid to the pressure chamber may be provided only in the flow path substrate without being provided in a separate member such as the case head, and may be provided only in the separate member such as the case head without being provided in the flow path substrate. The separate member also includes the pressure chamber substrate and the like.

The protective substrate may be omitted and may be integrally formed with the case head.

The nozzle plate may be integrally formed with the flow path substrate.

The second space S2 and the third space S3 may be provided in a position that is the same side of the outside of the pressure chamber from the first space S1 in the width direction D3, that is, the second space S2 and the third space S3 may be provided in positions where the first space S1 is not interposed therebetween.

Moreover, basic operations and effects of the invention are achieved, even without the inclined surfaces 13*a* and 14*a* in the pressure chamber substrate 10. Furthermore, the basic operations and effects of the invention are achieved, even without the third space S3 in the pressure chamber substrate 10.

The shape of the pressure chamber is not only a substantially rectangular shape in a plan view but may also be a substantially elliptical shape, a substantially polygonal shape, or the like in a plan view. The substantial ellipse includes an ellipse that contains a true circle, an egg shape, an oval having a straight portion, a similar shape thereof, and the like.

Figure 8:
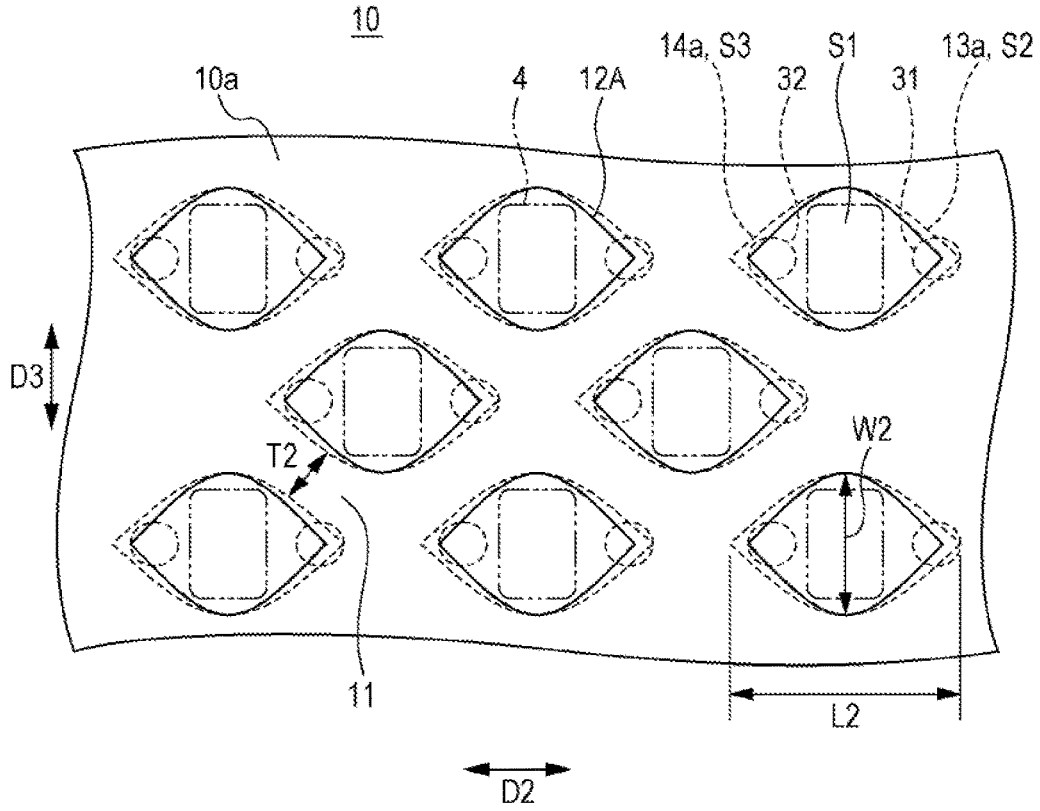
FIG. 8 is a plan view illustrating a main portion of a pressure chamber substrate of a modification example forming a substantially elliptical pressure chamber.

FIG. 8 is a plan view illustrating a main portion of a pressure chamber substrate 10 of a modification example forming a substantially oval (substantially elliptical) pressure chamber 12A in a plan view. The flow path substrate having the communication holes 31 and 32, and the like is bonded to the flow path substrate side surface of the pressure chamber substrate 10 forming the pressure chamber 12A. The first communication hole 31 is adjacent to the second space S2, in other words, at least a part thereof overlaps with the second space S2 in a plan view and the first communication hole 31 allows the second space S2 to communicate with the nozzle, and the first communication hole 31 is not adjacent to the first space S1, in other words, the first communication hole 31 does not overlap with the first space S1 in a plan view. The second communication hole 32 is adjacent to the third space S3, in other words, at least a part thereof overlaps with the third space S3 in a plan view and the second communication hole 32 allows the third space S3 to communicate with the common liquid chamber of the flow path substrate, and the second communication hole 32 is not adjacent to the first space S1, in other words, the second communication hole 32 does not overlap with the first space S1 in a plan view. The liquid from the common liquid chamber flows from the second communication hole 32 to the nozzle through the third space S3, the first space S1, the second space S2, and the first communication hole 31.

The maximum width W2 of the pressure chamber 12A illustrated in FIG. 8 in the width direction D3 of the pressure chamber is wider than the width W1 of the substantially rectangular pressure chamber 12 in a plan view illustrated in FIG. 4. A length L2 of the substantially oval pressure chamber 12A in the longitudinal direction D2 of the pressure chamber is shorter than a length L1 of the substantially rectangular pressure chamber 12. Therefore, the largeness of the pressure chamber in the longitudinal direction is suppressed.

Furthermore, the maximum width W2 of the substantially oval pressure chamber 12A is wider than the width W1 of the substantially rectangular pressure chamber 12 so that it is possible to obtain an equivalent displacement with the active section 4 having a smaller area and to apply an equivalent pressure to the pressure chamber with the active section 4 having a smaller area. Therefore, the largeness of the pressure chamber is suppressed.

Furthermore, it is possible to increase (to densify the pressure chamber 12A) the number of the pressure chambers 12A per unit area with respect to the pressure chamber substrate 10 by disposing the pressure chamber 12A between the four pressure chambers 12A adjacent to each other. Furthermore, a thickness T2 of the partition wall 11 partitioning the pressure chambers 12A disposed as described above can be thicker than a thickness T1 of the partition wall 11 partitioning the substantially rectangular pressure chambers 12 illustrated in FIG. 4. As a result, in the modification example, it is possible to increase the rigidity of the pressure chamber partition wall 11 and the like that easily receive a force from the active section 4, and to improve the structural strength of the pressure chamber 12, thereby improving the printing quality.

5. Conclusion

As described above, according to the invention, it is possible to provide the technique and the like of the liquid ejecting head capable of improving the structural strength of the pressure chamber by various aspects thereof. Of course, it is also possible to obtain the basic operations and effects described above with the technique configured only by configuration requirement according to the aspects of independent claims without having configuration requirements according to the aspects of dependent claims.

Furthermore, it is possible to perform a configuration in which the configurations disclosed in the embodiments and in the modification example described above are replaced with each other or a combination thereof is changed, and a configuration in which known techniques and the configurations disclosed in the embodiments and in the modification example described above are replaced with each other or a combination thereof is changed, and the like. The invention also includes these configurations and the like.

This application is a continuation application of United States patent application No. 14/444,891, filed Jul. 28, 2014, now U. S. Pat. No. 9,527,282, which patent application is incorporated herein by reference in its entirety. United States patent application No. 14/444,891 claims the benefit of and priority to Japanese Patent Application No: 2013-156499, filed Jul. 29, 2013 is expressly incorporated by reference herein in its entirety.

What is claimed is:

1. A liquid ejecting head comprising:

a nozzle, a pressure chamber, an actuator having an active section that is interposed between electrodes and applies pressure to the pressure chamber, a communication hole communicating with the nozzle and the pressure chamber, a first substrate that includes the pressure chamber, a second substrate that includes the communication hole, wherein the first substrate and the second substrate are laminated in a lamination direction, wherein the communication hole does not overlap with the active section in the lamination direction.

2. A liquid ejecting apparatus comprising the liquid ejecting head according to claim 1.

3. A liquid ejecting head comprising:

a nozzle, a pressure chamber, an actuator applying pressure to the pressure chamber, a vibration plate being located between the pressure chamber and the actuator, a communication hole communicating with the nozzle and the pressure chamber, a first substrate that includes the pressure chamber, a second substrate that includes the communication hole, wherein the first substrate and the second substrate are laminated in a lamination direction, wherein the vibration plate defines a wall of the pressure chamber on the side of the actuator, wherein the communication hole does not overlap with the wall of the pressure chamber on the side of the actuator in the lamination direction.

4. A liquid ejecting apparatus comprising the liquid ejecting head according to claim 3.

5. A liquid ejecting head comprising:

a nozzle, an actuator having an active section that is interposed between electrodes and applies pressure to a pressure chamber, the pressure chamber having a first space positioned in a region corresponding to the active section and a second space positioned nearer to the nozzle than the first space, a communication hole communicating with the nozzle and the pressure chamber, a first substrate that includes the pressure chamber, a second substrate that includes the communication hole, wherein the first substrate and the second substrate are laminated in a lamination direction, wherein the first substrate has an inclined surface defining a wall of the pressure chamber, the inclined surface being inclined so as to approach the communication hole as separating from the first space, wherein an edge section of the inclined surface on the side of the second substrate is positioned on the inside of the communication hole in a direction which is parallel to a surface of the second substrate.

6. A liquid ejecting apparatus comprising the liquid ejecting head according to claim 5.

7. A liquid ejecting head comprising:

a nozzle, an actuator having an active section that is interposed between electrodes and applies pressure to a pressure chamber, the pressure chamber having a first space positioned in a region corresponding to the active section and a third space positioned farther to the nozzle than the first space, a common liquid chamber in which a liquid to be supplied to the pressure chamber is stored, a second communication hole communicating with the common liquid chamber and the pressure chamber, a first substrate that includes the pressure chamber, a second substrate that includes the second communication hole, wherein the first substrate and the second substrate are laminated in a lamination direction, wherein the first substrate has an inclined surface defining a wall the pressure chamber, the inclined surface being inclined so as to approach the second communication hole as separating from the first space, wherein an edge section of the inclined surface on the side of the second substrate is positioned on the outside of the communication hole in a direction which is parallel to a surface of the second substrate.

8. A liquid ejecting apparatus comprising the liquid ejecting head according to claim 7.

* * * * *